US011052452B2

(12) United States Patent
Picard et al.

(10) Patent No.: US 11,052,452 B2
(45) Date of Patent: Jul. 6, 2021

(54) RIVETING METHOD FOR AIRCRAFT

(71) Applicant: SAFRAN, Paris (FR)

(72) Inventors: Sylvaine Picard, Moissy-Cramayel (FR); Yann Le Guilloux, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 16/633,674

(22) PCT Filed: Jul. 27, 2018

(86) PCT No.: PCT/FR2018/051935
§ 371 (c)(1),
(2) Date: Jan. 24, 2020

(87) PCT Pub. No.: WO2019/020959
PCT Pub. Date: Jan. 31, 2019

(65) Prior Publication Data

US 2021/0154727 A1 May 27, 2021

(30) Foreign Application Priority Data

Jul. 28, 2017 (FR) ..... 17 57206

(51) Int. Cl.
*B21J 15/04* (2006.01)
*B21J 15/28* (2006.01)
(Continued)

(52) U.S. Cl.
CPC ..... *B21J 15/043* (2013.01); *B21J 15/285* (2013.01); *B21J 15/105* (2013.01); *B21J 15/142* (2013.01)

(58) Field of Classification Search
CPC ..... B21J 15/285; B21J 15/105; B21J 15/142; B21J 15/043
See application file for complete search history.

(56) References Cited

U.S. PATENT DOCUMENTS 7,458,244 B2 * 12/2008 Dehike ..... B21J 15/32 227/2
7,729,796 B2 * 6/2010 Hartrampf ..... B21J 15/14 700/175
(Continued)

FOREIGN PATENT DOCUMENTS

DE 10 2014 106 312 A1 11/2015
EP 1 302 258 A1 4/2003
(Continued)

OTHER PUBLICATIONS

International Search Report dated Nov. 11, 2018 in PCT/FR2013/051935 filed on Jul. 27, 2018, 3 pages.
(Continued)

*Primary Examiner* — Bayan Salone
(74) *Attorney, Agent, or Firm* — Oblon, McClelland, Maier & Neustadt, L.L.P.

(57) ABSTRACT

A riveting method that includes riveting a first aircraft part to a second aircraft part. The method includes capturing a plenoptic image of the rivet and at least one of the first part and the second part in the vicinity of the rivet, by a plenoptic imaging device secured to a riveting head, after riveting the first part to the second part. The method includes detecting the positioning and the surface condition of the rivet, from the plenoptic image captured by the imaging device.

13 Claims, 4 Drawing Sheets

(51) Int. Cl.
*B21J 15/10* (2006.01)
*B21J 15/14* (2006.01)

(56) References Cited

U.S. PATENT DOCUMENTS

| | | | | |
|---|---|---|---|---|
| 9,032,602 | B2 * | 5/2015 | Woods | F16B 19/1072 29/407.03 |
| 9,579,712 | B2 * | 2/2017 | Schneider | B21J 15/142 |
| 10,072,694 | B2 * | 9/2018 | Woods | F16B 19/1072 |
| 10,399,199 | B2 * | 9/2019 | Carberry | B23Q 17/2466 |
| 2013/0014368 | A1 * | 1/2013 | Woods | B25B 27/0014 29/407.01 |
| 2014/0325810 | A1 * | 11/2014 | Schneider | G01B 11/00 29/407.04 |
| 2015/0211566 | A1 * | 7/2015 | Woods | G01L 5/24 73/862.21 |
| 2017/0056960 | A1 * | 3/2017 | Ficken | G01B 11/02 |
| 2018/0154491 | A1 * | 6/2018 | Carberry | B25J 3/04 |

FOREIGN PATENT DOCUMENTS

| | | | | |
|---|---|---|---|---|
| EP | 1302258 | A1 * | 4/2003 | B21J 15/285 |
| EP | 2 546 022 | A1 | 1/2013 | |
| EP | 2546022 | A1 * | 1/2013 | F16B 19/1072 |
| WO | WO 2013/053350 | A1 | 4/2013 | |
| WO | WO-2013053350 | A1 * | 4/2013 | B21J 15/142 |
| WO | WO 2016/174444 | A1 | 11/2016 | |

OTHER PUBLICATIONS

Preliminary French Search Report dated Apr. 11, 2018 in French Application No. 1757206 filed on Jul. 28, 2017.

* cited by examiner

RIVETING METHOD FOR AIRCRAFT

TECHNICAL FIELD

The invention relates to a riveting system for the manufacture of an aircraft. More specifically, the invention relates to the control of riveting operations.

Background of the Invention

Rivets are widely used in the aeronautical industry, for assembling aircraft parts in a non-dismountable manner by crimping. These rivets for aircraft are subjected to significant mechanical and thermal stresses. Moreover, they are generally selected so as to disturb the air flow around aircraft parts to a minimum.

The riveting operations are largely automated. They are performed using a riveting head which carries several tools involved in the riveting operations, Some riveting operations can be controlled in real time automatically, in particular using a curve of forces exerted on a rivet as a function of the displacement of a riveting head. Such a control method is for example disclosed in the application EP 1 302 258.

However, the riveting control operations are generally carried out by specialised operators, once all the rivets of a part have been assembled.

There is a need to verify the correct assembly of rivets for aircraft, in a reliable manner, in a limited time, as soon as possible after riveting and without interfering with riveting.

DESCRIPTION OF THE INVENTION

The invention aims at solving at least partially the problems encountered in the solutions of the prior art.

In this regard, the object of the invention is a riveting method comprising riveting a first aircraft part to a second aircraft part, by means of a riveting system comprising a riveting tool and a plenoptic image acquisition device.

The riveting tool is configured to assemble the first part to the second part by riveting, the riveting tool comprising a riveting head intended to come into contact with the first part and/or the second part. The plenoptic image acquisition device is secured to the riveting head.

According to the invention, the riveting method comprises capturing a plenoptic image of the rivet and of the surroundings of the rivet, by the image acquisition device after riveting the first part to the second part. The method comprises detecting the positioning and the surface condition of the rivet, from the plenoptic image captured by the image acquisition device.

Thanks to the riveting method according to the invention, the control of the condition of the rivet and the positioning of the rivet is performed as soon as the riveting has taken place. The plenoptic image acquisition device used has a small space requirement and does not disturb riveting. The displacements of the image acquisition device and the associated riveting head are limited. Thus, the use of a plenoptic image of the rivet and the surroundings thereof makes the control precise, reliable, fast and implemented on the same equipment.

A plenoptic image is a two-dimensional image sampling both the intensity of the light rays coming from a scene and the direction of said rays. Of course, capturing a plenoptic image can be understood as capturing a plurality of images.

The invention can optionally include one or more of the following features, whether or not combined with each other.

Advantageously, the riveting method comprises the three-dimensional reconstruction of the rivet and the surroundings of the rivet, from the image captured by the image acquisition device.

Advantageously, the riveting method comprises comparing the detected positioning of the rivet to a reference position of the rivet, and comparing the detected surface condition of the rivet to a reference surface condition of the rivet.

According to a particular feature of an embodiment, the riveting method comprises signalling a positioning and/or surface condition defect of the rivet, in particular when a rivet head flushness defect and/or a notch of the rivet have been detected.

According to one advantageous embodiment, the rivet is a blind rivet.

According to another advantageous embodiment, the rivet has a head intended to be flush with a surface of the first part and/or a surface of the second part, once it is assembled.

Preferably, the rivet is a countersunk head rivet.

According to another particular feature of an embodiment, the riveting method comprises riveting a first rivet, to assemble the first part to the second part by a riveting method as defined above. The method further comprises riveting a second rivet, to assemble the first part to the second part by a riveting method as defined above.

Advantageously, the riveting method comprises comparing the detected positioning of the second rivet to the detected positioning of the first rivet.

According to an advantageous embodiment, the riveting method comprises comparing the detected surface condition of the second rivet to the detected surface condition of the first rivet.

Advantageously, the riveting method comprises establishing rivet placement statistics.

The invention also relates to a riveting system for aircraft, comprising a riveting tool configured to assemble a first aircraft part to a second aircraft part by riveting. The riveting tool comprising a riveting head intended to come into contact with the first part and/or the second part.

According to the invention, the riveting system comprises a plenoptic image acquisition device, configured to capture a plenoptic image of the rivet and of the surroundings of the rivet after riveting the first part to the second part. The image acquisition device is secured to the riveting head.

Particularly, the plenoptic image acquisition device is configured to capture images with variable focusing areas at least along the direction of the longitudinal axis of the riveting head, when the riveting head is stationary relative to the first part and to the second part.

Advantageously, the riveting head comprises a rotary barrel and riveting tools. The rotary barrel includes housings distributed circumferentially around a longitudinal axis of the riveting head. The riveting tools perform various operations involved in the riveting. The riveting tools are intended to be housed in the barrel housings. The image acquisition device is housed in one of the barrel housings.

The riveting tools are in particular different from each other.

According to a particular feature of an embodiment, the riveting tools comprise a tool for drilling an orifice passing through the first part and the second part, a tool for inserting a rivet pin and/or a rivet body, and/or a riveter.

BRIEF DESCRIPTION OF THE DRAWINGS

The present invention will be better understood upon reading the description of exemplary embodiments, provided only for an indicative and non-restrictive purpose, with reference to the appended drawings wherein.

DETAILED DESCRIPTION OF SPECIFIC EMBODIMENTS

Figure 1:
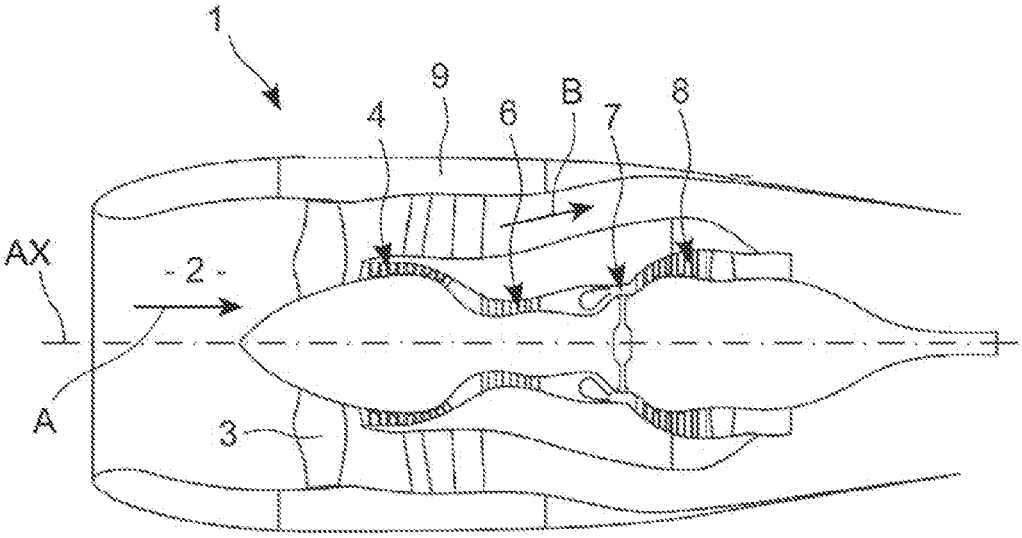
FIG. 1 is a partial schematic representation of a turbomachine for aircraft.

FIG. 1 represents a bypass and double spool turbomachine 1. The turbomachine 1 is a turbojet engine which has a shape of revolution about a longitudinal axis AX.

The turbomachine 1 comprises, from upstream to downstream on the pathway of a primary flow A, an air inlet duct 2, a fan 3, a low pressure compressor 4, a high pressure compressor 6, a combustion chamber 7, a high pressure turbine 8 and a low pressure turbine 10.

The upstream and downstream directions are used in this document with reference to the overall flow of gases in the turbojet engine, such a direction is substantially parallel to the direction of the longitudinal axis AX.

The low pressure compressor 4, the high pressure compressor 6, the high pressure turbine 8 and the ow pressure turbine 10 delimit a secondary flow path of a secondary flow B which bypasses them.

The high pressure compressor 6 and the high pressure turbine 8 are mechanically connected by a drive shaft 5 of the high pressure compressor 6, so as to form a high pressure body of the turbomachine 1. Similarly, the low pressure compressor 4 and the low pressure turbine 10 are mechanically connected by a turbomachine shaft 1, so as to form a low pressure body of the turbomachine 1.

The low pressure compressor 4, the high pressure compressor 6, the combustion chamber 7, the high pressure turbine 8 and the low pressure turbine 10 are surrounded by a casing 9 which extends from the inlet duct 2 to the low pressure turbine 10.

Figure 2C:
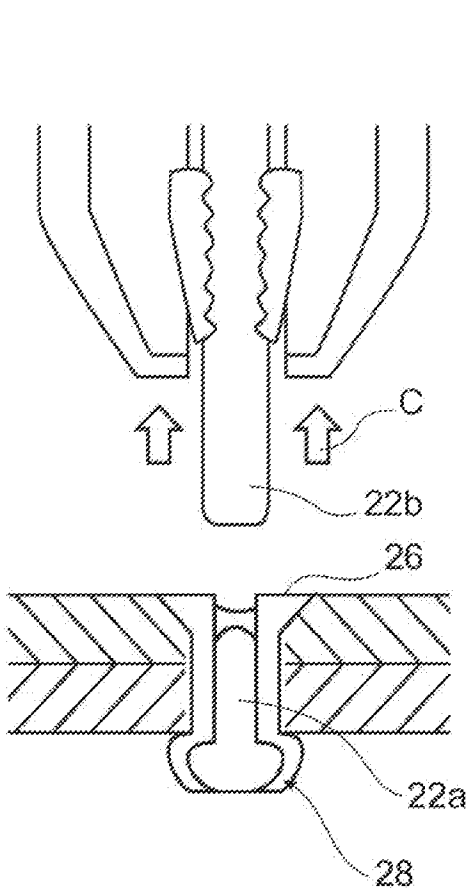
FIGS. 2*a*, 2*b* and 2*c* illustrate a riveting operation for aircraft using a riveting system according to a first preferred embodiment.
Figure 2B:
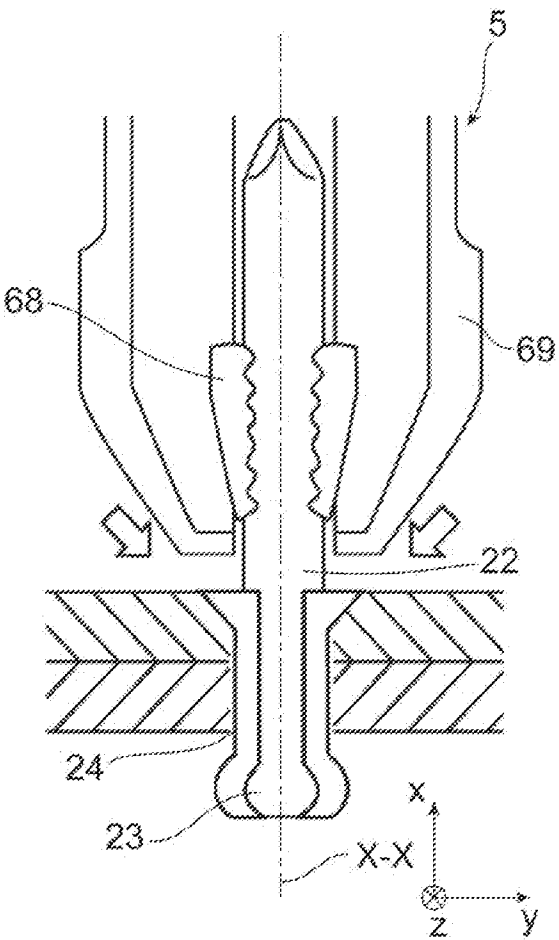
Figure 2A:
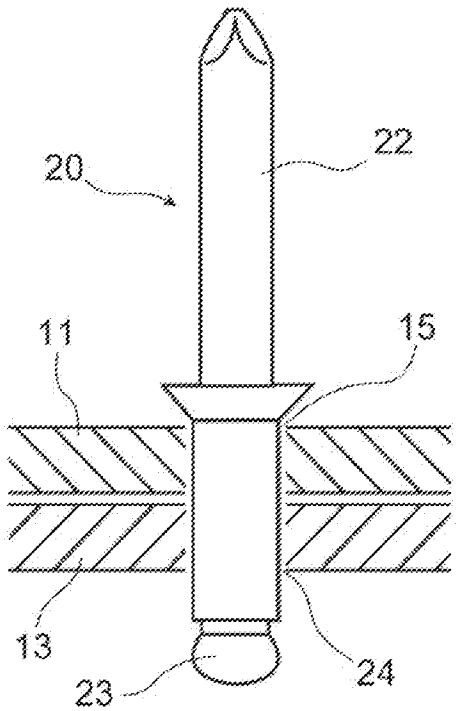

FIGS. 2*a* to 2*c* represent the steps of placing a blind rivet 20 to assemble by crimping a first aircraft part 11 to a second aircraft part 13. The first part 11 and the second part 13 are for example segments of the casing 9 or else other nacelle segments for aircraft.

The blind rivet 20 is also known under the name of «POP» rivet. It comprises a pin 22 and a body 24 which forms an annular ring around the pin 22, The pin 22 comprises a head 23 at one of its ends, which is intended to be part of the rivet seam 28 once the rivet 20 has been installed. The upper end of the body 24 forms a head 26 of the rivet, once the rivet 20 has been installed.

In a first step shown in FIG. 2*a*, the rivet 20 is inserted into an orifice 15 which passes through the first part 11 and the second part 13. This orifice 15 comprises a countersunk portion at the first part 11, which is intended for retain the countersunk head 26.

In an intermediate step shown in FIG. 2*b*, the pin 22 of the rivet is pulled upwards in an assembly direction X-X by a riveter 68, opposite the first part 11 and the second part 13. The riveter 68 is typically a riveting pliers comprising a jaw 69 to grip the pin 22.

In a final step shown in FIG. 2*c*, the pin 22 split into an upper portion of the pin 22*h* and a lower portion 22*a*. The upper portion 22*b* is removed by the riveting pliers 68 according to the arrow C. The lower portion 22*a* is remained to assemble the first part 11 to the second part 13. The upper end of the body forms the countersunk head 26 which is flush with the upper surface of the first part 11, The flushness of the head 26 allows limiting the aerodynamic disturbances created by the rivet 20 on the surface of the first part 11.

The head 23 of the pin and the lower end of the body 24 are flattened against the second part 13, to form the rivet seam 28, The first part 11 is then riveted to the second part 13.

Figure 3A:
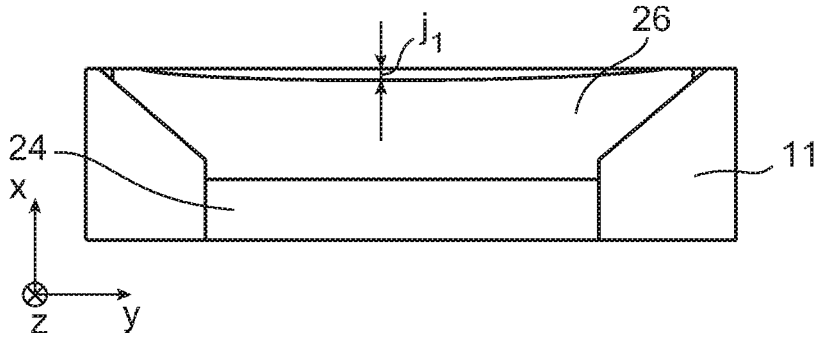
FIGS. 3*a*, 3*b* illustrate two types of assembly defects capable of being detected by the riveting system.

FIG. 3*a* represents a first possible flushness defect for the rivet 20. In this case, there is a clearance $j_1$ between the upper surface of the rivet head 20 and the upper surface of the first part 11, which can lead to aerodynamic disturbances of the flow in the proximity of the first part 11.

Figure 3B:
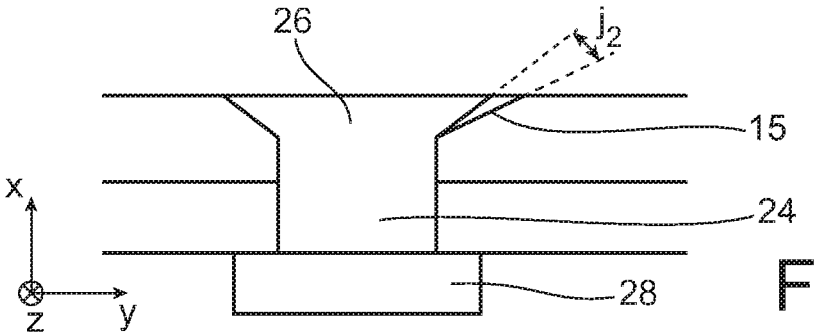

FIG. 3*b* shows a second possible flushness defect for the rivet 20. In this case, there is a clearance $j_2$ between the lateral surface of the rivet head 20 and the upper surface of the first part 11, which can lead to aerodynamic disturbances of the flow in the proximity of the first part 11 and possibly to a poorer mechanical strength of the rivet 20.

The riveting system 5 comprises a riveting tooling 30 and a control system 50 which is used to detect the possible assembly defects of the rivet 20 such as those shown in FIGS. 3*a* and 3*b*.

Figure 4:
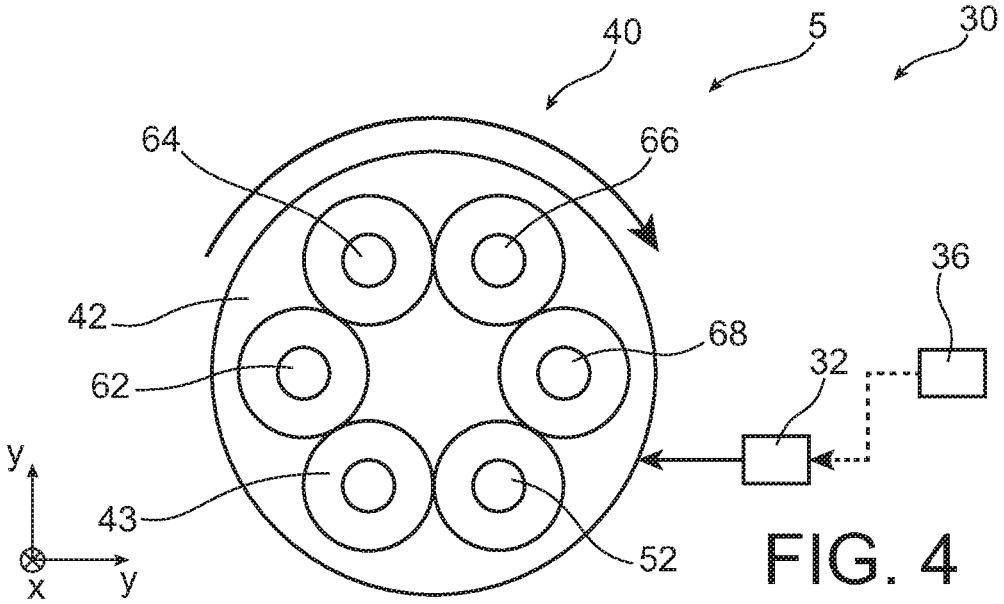
FIG. 4 is a partial schematic representation of ne riveting system with the riveting head thereof in cross-sectional view.
Figure 5:
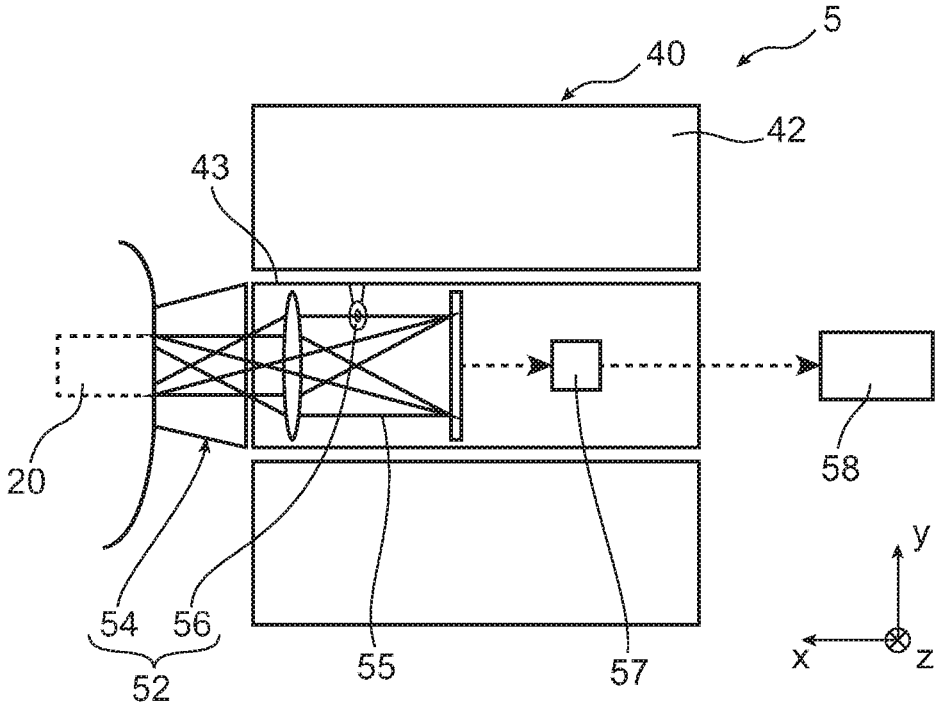
FIG. 5 is a partial schematic representation of the riveting system with the riveting head thereof in longitudinal section, particularly detailing the positioning of the plenoptic sensor and schematising the light ray trajectory.

With reference to FIGS. 4 and 5, the riveting tooling 30 comprises a riveting head 40, means for displacing the riveting head 32 and a command system 36.

The riveting tooling 30 is configured to assemble the first aircraft part 11 to the second aircraft part 13 by blind rivets 20, in an automated manner.

The riveting head 40 comprises a rotary barrel 42. It carries riveting tools 62, 64, 66, 68 and an image acquisition device 52 which is part of the riveting control system 50, The riveting head 40 is intended to come into contact with the first part 11 and/or the second part 13 to assemble them by riveting.

The barrel 42 includes housings 43 which are distributed circumferentially around the longitudinal axis X-X of the riveting head 40. The longitudinal axis X-X of the riveting head 40 corresponds to the rivet 20 assembly direction when the rivet 20 is being assembled. The barrel 42 is rotatable about the longitudinal axis X-X of the riveting head.

The housings 43 are used to house the various riveting tools 62, 64, 66, 68 which are involved in the various operations necessary for the riveting. At least one of the housings 43 is used to house the image acquisition device 52.

The riveting tools 62, 64, 66, 68 comprise a first drilling tool 62, a second drilling tool 64, a rivet insertion tool 66 and the riveter 68 that has been described above with reference to FIGS. 2*a* to 2*c*. The first drilling tool 62 is used to drill the through orifice 15 which passes through the first part 11 and the second part 13. The second drilling tool 64 is used to make a bore in the first part to house the countersunk head 26 in the upper part of the through orifice 15. The insertion tool 66 is used to insert the rivet body 24 and the rivet pin 22 in the assembly direction X-X.

The assembly direction X-X, a first lateral direction Y-Y and a second lateral direction Z-Z form an orthonormal reference frame centred on the rivet head 20. It is for example shown in FIGS. 2*a* to 2*c* and in FIGS. 3*a* to 3*b*.

In FIG. 4, a first one of the housings 43 houses the first drilling tool 62. A second housing 43 houses the second drilling tool 64. A third housing 43 houses the insertion tool 66. A fourth housing 43 houses the riveter 68. A fifth housing houses the image acquisition device 52.

The means for displacing 32 the riveting head comprise a motor and an arm at the end of which is located the riveting head 40. The motor is capable of rotating the barrel 42 about the longitudinal axis X-X of the riveting head 40, to bring each of the riveting tools 62, 64, 66, 68 and the image acquisition device 52, in turn, facing the place where the rivet 20 is intended to be installed. The arm is intended to displace the riveting head 40 in translation, in particular along the assembly direction X-X, the first lateral direction Y-Y and the second lateral direction Z-Z.

The command system 36 is used to command the displacement means 32 to displace the barrel 42. It also used to command the operation of each of the riveting tools 62, 64, 66, 68 independently of each other, as well as the operation of the image acquisition device 52.

With joint reference to FIGS. 4 and 5, the control system 50 comprises the image acquisition device 52 and a control unit 58.

The image acquisition device 52 is a plenoptic image acquisition device. It comprises a plenoptic sensor 54. It also includes a light source 56. The image acquisition device 52 is housed in the housing 43. It is secured to the riveting head 40.

The plenoptic sensor 54 comprises an optical system 55 and a processing unit 57. It is configured to capture one or more image(s) of the rivet 20 once it has been assembled. The plenoptic sensor 54 is a digital image acquisition device which senses the light intensity of the rivet 20, and which samples the directions of arrival of the light rays coming from the rivet 20. By an approach of triangulation of the rays coming from a same point on the rivet, it is possible to reconstruct the position of this point. If this operation is carried out for all the points seen by a plenoptic sensor 54, a three-dimensional reconstruction of the rivet and the neighbouring surface thereof is obtained.

The optical system 55 comprises a plurality of micro-objectives forming a matrix.

The processing unit 57 is configured to process the signal it receives from the optical system 55, to form the image of the rivet 20.

The light source 56 is intended to illuminate the rivet 20, so that the plenoptic sensor 54 can image-capture the rivet 20. It is preferably located in the housing 43 of the plenoptic sensor 54 or in the proximity of the area to be imaged.

The control unit 58 is a computer unit. It is connected to the processing unit 57. In particular, it includes a memory and a microprocessor.

The control unit 58 is configured to detect the positioning and the surface condition of the rivet 20 from the images captured by the image acquisition device 52. For this purpose, it performs the three-dimensional reconstruction of the rivet 20 and it also uses at least a two-dimensional image of the rivet 20 and the neighbouring surface thereof. The control unit 58 is then configured to compare the detected positioning of the rivet 20 to a reference position. It is also configured to compare the detected surface condition of the rivet 20 to a reference surface condition for the rivet 20.

It is configured to deduce therefrom a defect in the placement of the rivet 20 such as a flushness defect of a head of the rivet 26 and/or a notch of the rivet or a defect called cosmetic defect such as a stain or a scratch which would be seen in the two-dimensional image. The detected flushness defects are in particular those shown in FIGS. 3*a* and 3*b*. If it does not detect any defect in the placement of the rivet 20, the control unit 58 validates the placement of the rivet 20.

The control unit 58 is also configured to compare the positioning and the surface condition of the rivet 20 relative to the positioning and the surface condition of other rivets. Thus, it allows establishing rivet 20 placement statistics. It is configured to be connected to an audible, tactile and/or visual alarm to warn an operator in case of a rivet 20 assembly error and/or of an abnormally high number of rivet 20 assembly errors.

Figure 6:
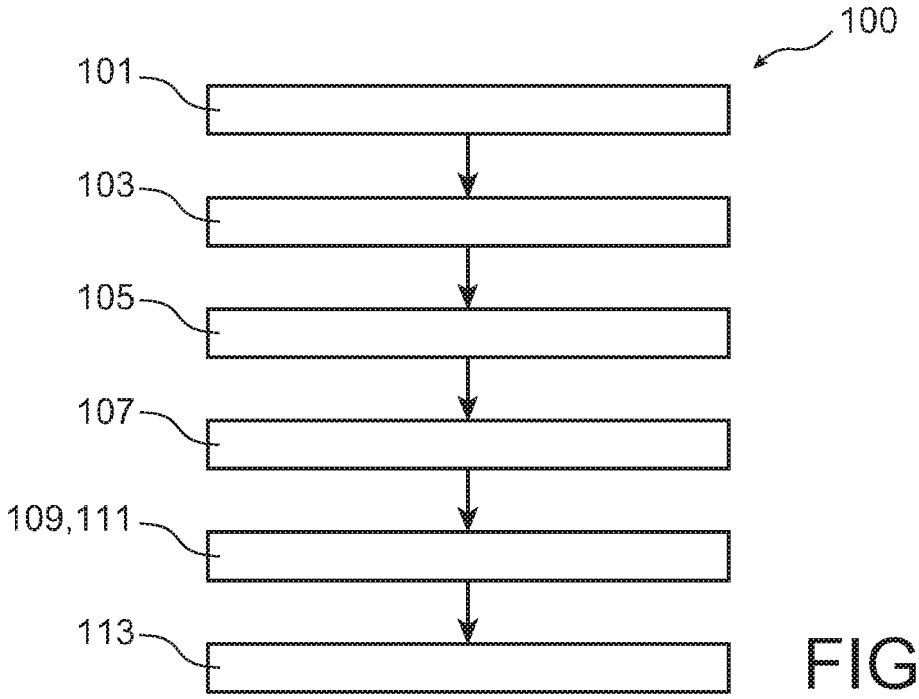
FIG. 6 illustrates a riveting method using the riveting system according to the first embodiment.

The method for riveting a first rivet 20 is described with reference to FIG. 6. The riveting method 100 begins with the placement of the first rivet 20 by the riveting tooling 30, in step 101.

Then, the image acquisition device 52 captures images of the rivet 20 and of the first part 11 and/or of the second part 13 and of the surroundings of the rivet 20 in step 103, once the rivet 20 has been placed and assembles the first part 11 to the second part 13.

The processing unit 57 and the control unit 58 then detect the positioning of the rivet 20, in step 105. They also detect the surface condition of the rivet 20, in step 105.

The control unit 58 compares the detected positioning of the rivet 20 to a reference positioning of the rivet 20 relative to the first part 11 and relative to the second part 13, in step 107. The control unit 58 compares the surface condition of the rivet 20 to the reference surface condition for the rivet 20.

The control unit 58 can then validate the placement of the rivet 20 if it has not detected any defect related to the placement of the rivet 20 such as a flushness defect or a notch of the rivet 20.

Alternatively, the control unit 58 can detect a defect related to the placement of the rivet 20. In this case, the riveting tooling 30 and/or an operator can remove the defective rivet 20 to install a new one.

In step 109, the control unit 58 compares the placement of the first rivet 20, that is to say the positioning and the surface condition of the first rivet 20, to the positioning and the surface condition of other rivets. In particular, it establishes statistics on the placement of the rivets, in step 111.

In case of a defect in the placement of the first rivet 20 detected by the control unit 58, an operator can be warned by the control system 50, in step 113. Particularly, an operator is warned in case of recurrent defects in the placement of rivets 20, in order to limit possible future errors.

Steps 103, 105, 107, 111 and 113 together form a method for inspecting the riveting which is implemented once the rivet has been placed in step 101.

Once the first rivet 20 has been placed and the inspection of the first rivet 20 has taken place, the riveting method 100 is repeated with a second rivet 20 which is different from the first rivet. The method is repeated until the first part 11 is assembled by crimping by rivets to the second part 13.

The image acquisition device 52 is configured to capture images of the rivet 20 once it has been assembled to the first part 11 and to the second part 13, to quickly control its condition and its positioning, without interfering with the riveting.

Particularly, the capture of plenoptic images of the rivet 20 and the surroundings thereof, that is to say of images with variable focusing areas along the assembly direction X-X, along the first lateral direction Y-Y and along the second lateral direction Z-Z by the image acquisition device 52, facilitates the subsequent analysis of these images by the control unit 58 to conclude on the condition and the position of the rivet 20 once it is placed.

The plenoptic image acquisition device 52 has a limited space requirement, which allows housing it in the barrel 42 and not to interfere with the riveting operations.

Of course, various modifications can be made by the person skilled in the art to the invention which has just been described without departing from the scope of the description of the invention.

Particularly, some steps of the riveting method 100 can take place simultaneously. For example, step 105 of detecting the positioning and the surface condition of the rivet can be done simultaneously with step 107 of comparing the positioning and the surface condition of the rivet 20. Alternatively or in addition, step 105 of detecting the positioning and the surface condition of the rivet can be carried out by the processing unit 57 simultaneously with step 103 of capturing images.

The detection of the positioning and the detection of the rivet 20 condition can be performed visually by an operator on the basis of the images captured by the plenoptic image acquisition device 52, at least as regards some rivets 20.

Alternatively, the light source 56 is integrated into the plenoptic sensor 54.

Alternatively or in addition, the control unit 58 is housed in the housing 43 of the plenoptic sensor 54.

Alternatively, the displacement means 32 are configured to move forward and/or move backward the plenoptic image acquisition device 52 relative to the housing 43 thereof.

Alternatively, the rivet insertion tool 66 is replaced by a pin insertion tool and by a body insertion tool.

The riveter 68 can form a single riveting tool with the rivet insertion tool 66. The shape of the riveter 68 may vary, particularly if the rivet 20 is a snap rivet.

The rivet 20 can be replaced by a solid rivet. Furthermore, the rivet head 26 can be domed, in particular if the rivet 20 is not likely to generate aerodynamic disturbances for the aircraft.

The first part 11 and the second part 13 can be formed by different casing segments of the turbomachine 1.

The invention claimed is:

1. A riveting method comprising riveting a first aircraft part to a second aircraft part, by means of a riveting system comprising:

a riveting tooling configured to assemble the first part to the second part by riveting, wherein the riveting tooling comprises a riveting head that is intended to come into contact with the first part and/or the second part, and a plenoptic image acquisition device, wherein the plenoptic image acquisition device is secured to the riveting head, the riveting method further comprising:

capturing a plenoptic image of a rivet and of the surroundings of the rivet, by the image acquisition device, after riveting the first part to the second part, and detecting the positioning and the surface condition of the rivet, from plenoptic image captured by the image acquisition device.

2. The riveting method according to claim 1, comprising the three-dimensional reconstruction of the rivet and of the surroundings of the rivet.

3. The riveting method according to claim 1, comprising comparing the detected positioning of the rivet to a reference position of the rivet and comparing the detected surface condition of the rivet to a reference surface condition of the rivet.

4. The riveting method according to claim 3, comprising signalling a positioning and/or surface condition defect of the rivet.

5. The riveting method according to claim 4, comprising signalling a positioning and/or surface condition defect of the rivet, when a rivet head flushness defect and/or a notch of the rivet have been detected.

6. The riveting method according to claim 1, wherein the rivet is a blind rivet and/or wherein the rivet has a head intended to be flush with a surface of the first part and/or a surface of the second part after riveting.

7. The riveting method according to claim 6, rein the rivet s a countersunk head rivet.

8. The riveting method according to claim 1, further comprising:

riveting a first rivet to assemble the first part to the second part, and riveting a second rivet to assemble the first part to the second part.

9. The riveting method according to claim 8, comprising comparing the detected positioning of the second rivet to the detected positioning of the first rivet and/or comparing the detected surface condition of the second rivet to the detected surface condition of the first rivet.

10. The riveting method according to claim 7, comprising establishing rivet placement statistics.

11. A riveting system for aircraft, comprising a riveting tooling configured to assemble a first aircraft part to a second aircraft part by riveting, the riveting tooling comprising a riveting head intended to come into contact with the first part and/or the second part, wherein the riveting system comprises a plenoptic image acquisition device, configured to capture a plenoptic image of the rivet and the surroundings of the rivet after riveting the first part to the second part by the rivet, wherein the image acquisition device is secured to the riveting head.

12. The riveting system according to claim 11, wherein the riveting head comprises:

a rotary barrel which includes housings distributed circumferentially around a longitudinal axis of the riveting head, and riveting tools which are different from each other and which perform various operations involved in riveting, wherein the riveting tools are intended to be housed in the housings of the barrel, wherein the image acquisition device is housed in one of the housings of the barrel.

13. The riveting system according to claim 12, wherein the riveting tools comprise a tool for drilling an orifice passing through the first part and the second part, for inserting a rivet pin and/or a rivet body, and/or a riveter.

* * * * *